US008635936B2

(12) United States Patent
Lee

(10) Patent No.: US 8,635,936 B2
(45) Date of Patent: Jan. 28, 2014

(54) PUNCHING DEVICE

(76) Inventor: Chung-Yi Lee, Hsin-Tien (TW)

( * ) Notice: Subject to any disclaimer, the term of this patent is extended or adjusted under 35 U.S.C. 154(b) by 650 days.

(21) Appl. No.: 12/705,715

(22) Filed: Feb. 15, 2010

(65) Prior Publication Data

US 2011/0107889 A1 May 12, 2011

(30) Foreign Application Priority Data

Nov. 10, 2009 (TW) ..... 98220823 U

(51) Int. Cl.

| | |
|---|---|
| ***B26D 7/06*** | (2006.01) |
| ***B26D 7/08*** | (2006.01) |
| ***B26D 7/02*** | (2006.01) |
| ***B26D 5/08*** | (2006.01) |
| ***B26F 1/14*** | (2006.01) |

(52) U.S. Cl.
USPC ..... 83/125; 83/686; 83/129; 83/588; 83/633; 83/621

(58) Field of Classification Search
USPC ..... 83/109, 111, 129, 168, 588, 621, 627, 83/467.1, 686, 633, 582, 635, 620
See application file for complete search history.

(56) References Cited

U.S. PATENT DOCUMENTS

| | | | | |
|---|---|---|---|---|
| 1,428,174 | A * | 9/1922 | Luther | 83/124 |
| 4,791,844 | A * | 12/1988 | Yonezawa | 83/133 |
| 5,647,278 | A * | 7/1997 | Wu | 101/368 |
| 6,089,137 | A * | 7/2000 | Lee | 83/621 |
| 6,428,248 | B1 | 8/2002 | Lee | |

* cited by examiner

*Primary Examiner* — Kenneth E. Peterson
*Assistant Examiner* — Samuel A. Davies
(74) *Attorney, Agent, or Firm* — The Webb Law Firm

(57) ABSTRACT

A punching device includes: a base including a die part that has a top wall; an abutting member connected to the base; a punch supported on the base, movable relative to the die part and the abutting member between upper and lower positions; and an ejecting unit supported on the base and including a non-compressible ejecting element disposed above and adjacent to the top wall of the die part. The punch is movable relative to the ejecting unit at least during movement of the punch from a middle position to the lower position. The ejecting unit abuts against the abutting member at least when the punch is disposed at the upper position.

14 Claims, 15 Drawing Sheets

PUNCHING DEVICE

CROSS-REFERENCE TO RELATED APPLICATION

This application claims priority of Taiwanese Application No. 098220823, filed on Nov. 10, 2009.

BACKGROUND OF THE INVENTION

1. Field of the Invention

This invention relates to a punching device, more particular to a punching device including an ejecting unit for preventing a cutout portion of a workpiece cut by a punch from being raised during restoration of the punch to an upper position.

2. Description of the Related Art

As illustrated in FIGS. 1 and 2, U.S. Pat. No. 6,428,248 discloses a conventional punching device that includes a housing 90, a die part 91 mounted in a lower side of the housing 90, and a punch 92 mounted in an upper side of the housing 90 and slidable toward the die part 91 to provide a shear force to cut a workpiece 9 disposed on a top wall of the die part 91. The punch 92 includes inner and outer blades 921, 922 that cooperatively define an accommodating space 920 for receiving an elastic ejecting member 93 therein. The die part 91 is formed with holes 910 for extension of the inner and outer blades 921, 922 therein during punching. In operation, when the punch 92 is moved from an upper position (see FIG. 1) to a lower position (see FIG. 2), the elastic ejecting member 93 undergoes a process that it first presses the workpiece 9 against the top wall of the die part 91 when the workpiece 9 is cut to form a desired cutout portion, and is subsequently compressed by the punch 92 and the top wall of the die part 91 as the top wall of the die part 91 is gradually moved into the accommodating space 920 and the inner and outer blades 921, 922 are respectively and gradually moved into the holes 910 in the die part 91. When the punch 92 is restored from the lower position to the upper position, the elastic ejecting member 93 elastically pushes the cutout portion of the workpiece 9 out of the accommodating space 920 so that the cutout portion can remain on the top wall of the die part 91 for subsequent removal therefrom. However, when the cutout portion of the workpiece 9 has a complicated pattern or a pattern having fine segments, manufacture of an elastic ejecting member or a spring corresponding to the cutout portion is extremely difficult. Moreover, the use of the elastic ejecting member or a spring in the punching device requires a larger space to accommodate the same in order to permit deformation thereof.

SUMMARY OF THE INVENTION

Therefore, an object of the present invention is to provide a punching device that can overcome the aforesaid drawbacks associated with the prior art.

According to the present invention, there is provided a punching device for cutting a workpiece to form a cutout portion. The punching device comprises: a base including a die part that has a top wall defining at least one die edge and adapted to support the cutout portion thereon; an abutting member connected to the base; a spring-biased punch supported on the base, movable relative to the die part and the abutting member between upper and lower positions, and having at least one blade edge, the blade edge being disposed above the die edge when the punch is disposed at the upper position, and being disposed below the die edge when the punch is disposed at the lower position, the blade edge being slidable toward the die edge for cutting the workpiece; and an ejecting unit supported on the base and including a non-compressible ejecting element disposed spacedly above and adjacent to the top wall of the die part. The punch is movable relative to the ejecting unit at least during movement of the punch from a middle position between the upper and lower positions, where the blade edge is substantially flush with the die edge, to the lower position. The ejecting unit abuts against the abutting member at least when the punch is disposed at the upper position so as to permit the ejecting element to eject the cutout portion of the workpiece, which is undesirably raised by the punch upon restoration of the punch from the lower position to the upper position, from the punch.

BRIEF DESCRIPTION OF THE DRAWINGS

In drawings which illustrate embodiments of the invention.

DETAILED DESCRIPTION OF THE PREFERRED EMBODIMENTS

Figure 1:
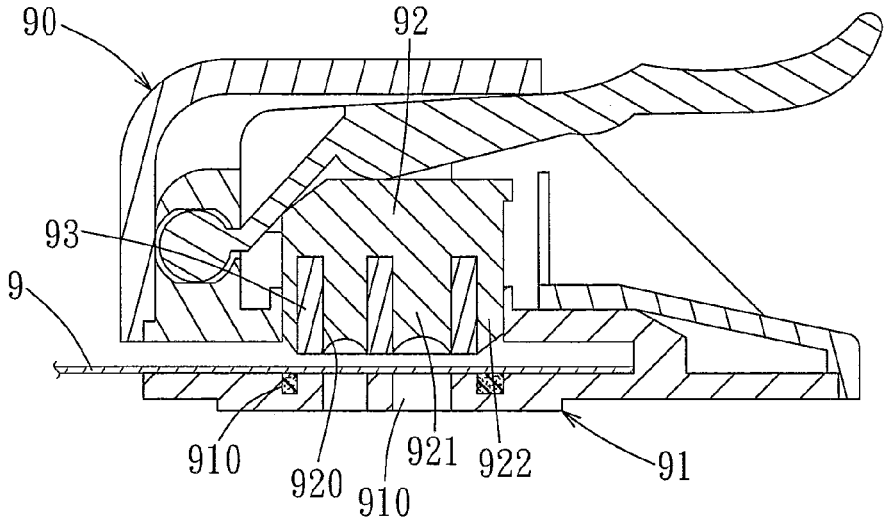
FIG. 1 PRIOR ART
FIG. 1 is a sectional view of a conventional punching device, illustrating a state where a punch thereof is disposed at an upper position.
Figure 2:
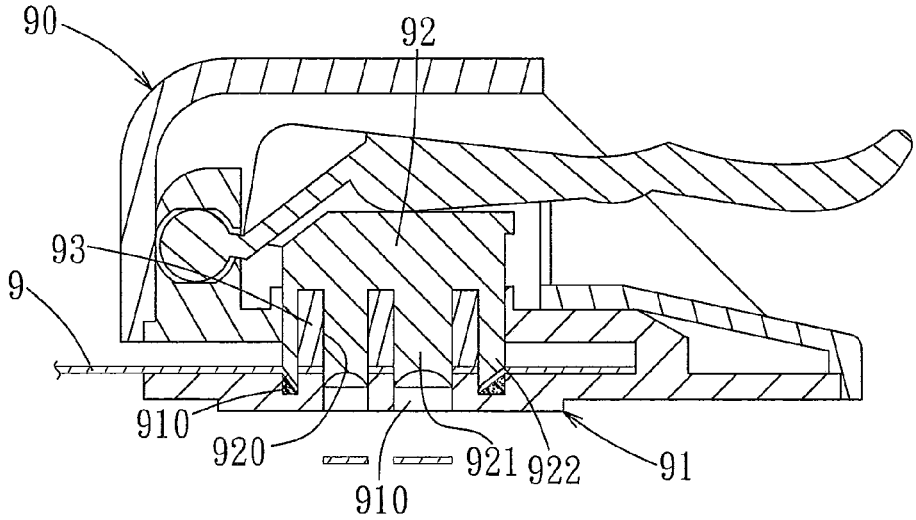
FIG. 2 PRIOR ART
FIG. 2 is a sectional view of the conventional punching device, illustrating another state where the punch is disposed at a lower position.
Figure 3:
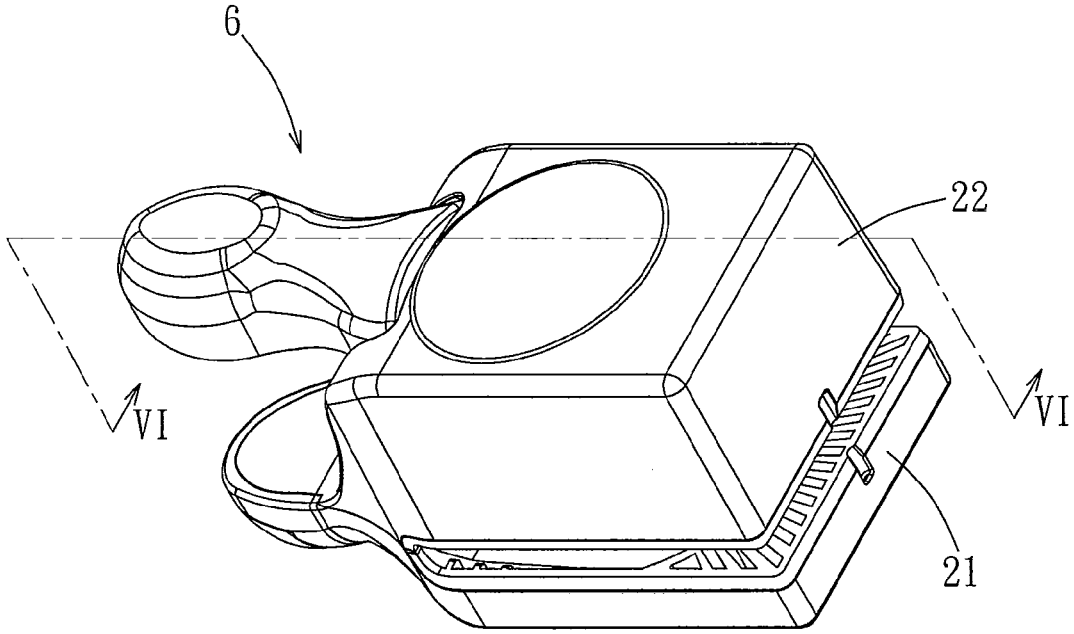
FIG. 3 is an assembled perspective view of the first preferred embodiment of a punching device according to this invention.
Figure 4:
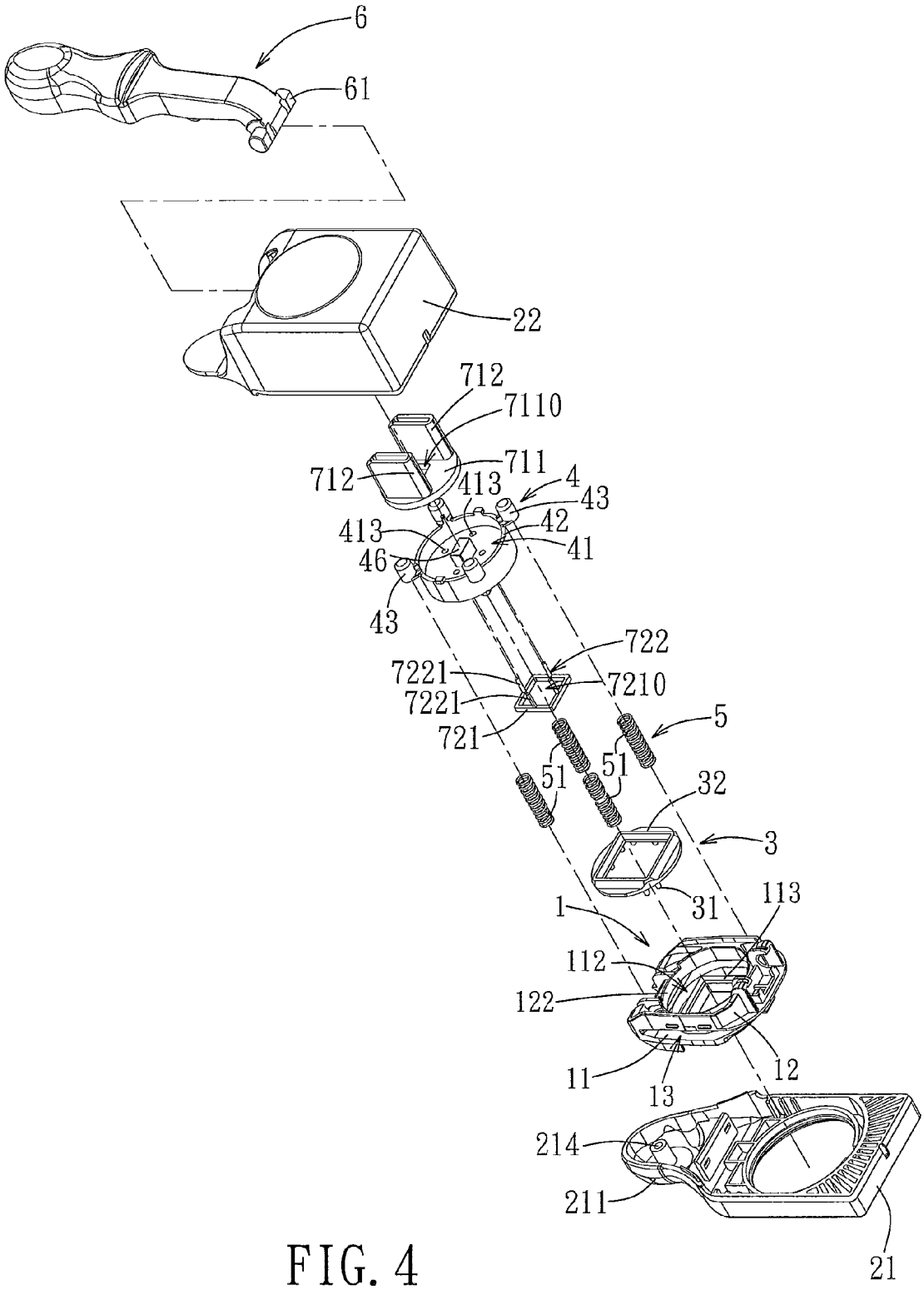
FIG. 4 is an exploded top perspective view of the first preferred embodiment.
Figure 5:
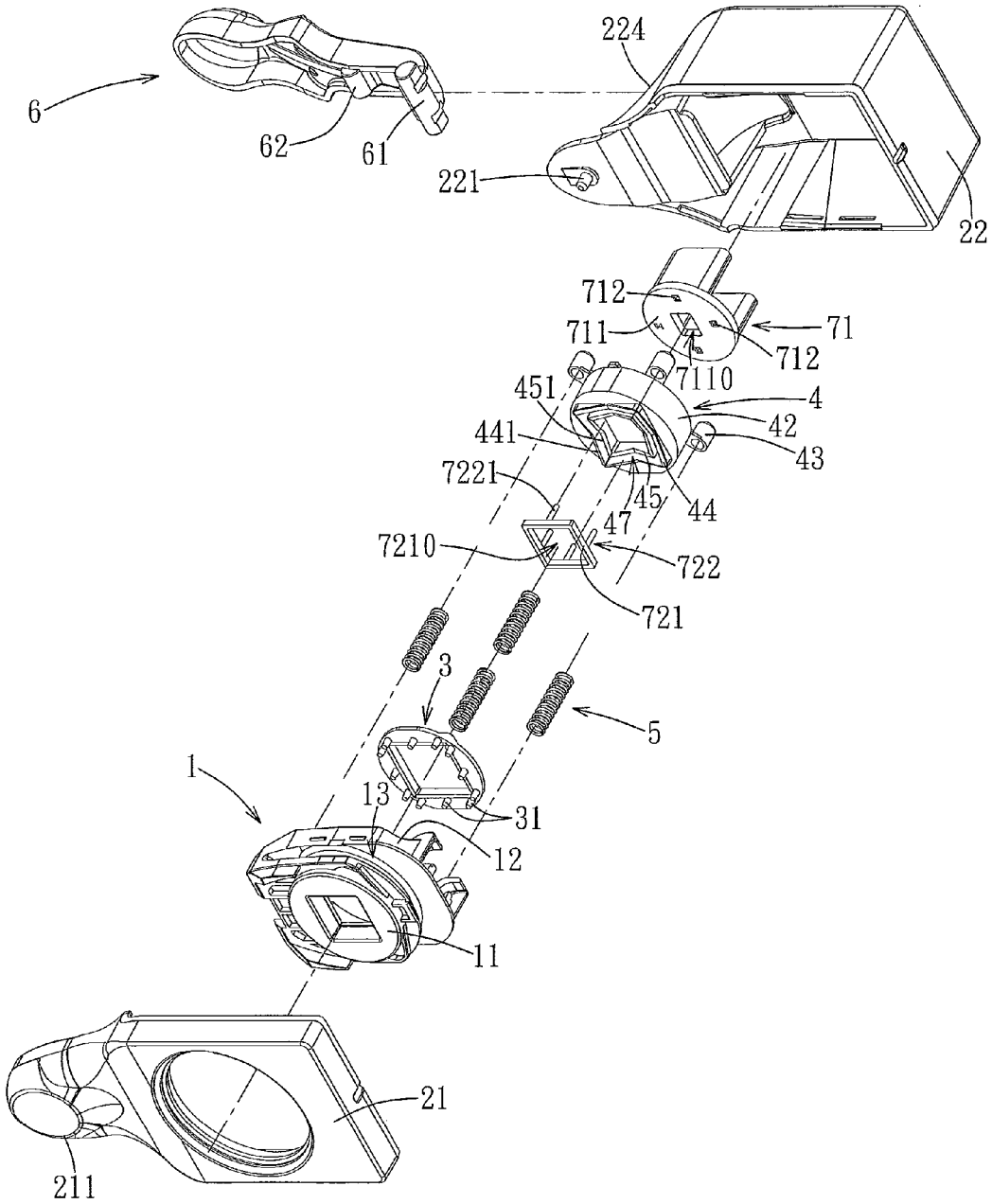
FIG. 5 is an exploded bottom perspective view of the first preferred embodiment.

Before the present invention is described in greater detail with reference to the accompanying preferred embodiments, it should be noted herein that like elements are denoted by the same reference numerals throughout the disclosure.

Figure 11A:
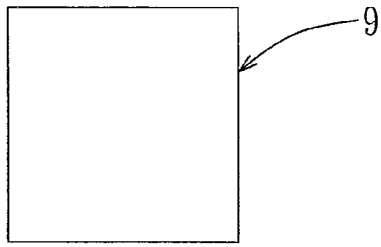
FIGS. 11A-11C are top views to illustrate how a workpiece is cut to form desired cutout portions by the first preferred embodiment.
Figure 11B:
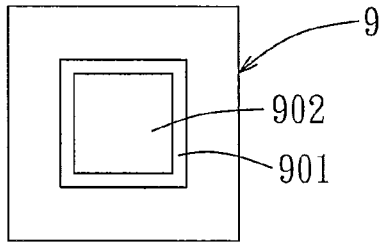
Figure 11C:
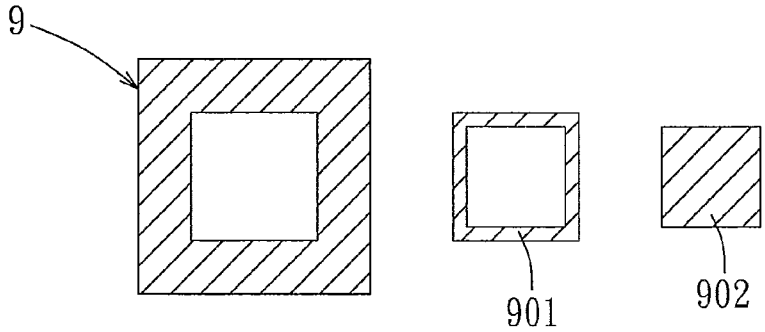

Referring to FIGS. 3 to 8, the first preferred embodiment of a punching device for cutting a workpiece 9 configured as a sheet of paper to form first and second cutout portions 901, 902 (see FIGS. 11A-11C) according to the present invention is shown to include upper and lower housings 21, 22, a base 1, a spring-biased punch 4, an operating lever 6, an upper housing 22 connected securely to the base 1 and serving as an abutting member, and an ejecting unit 7.

Figure 9:
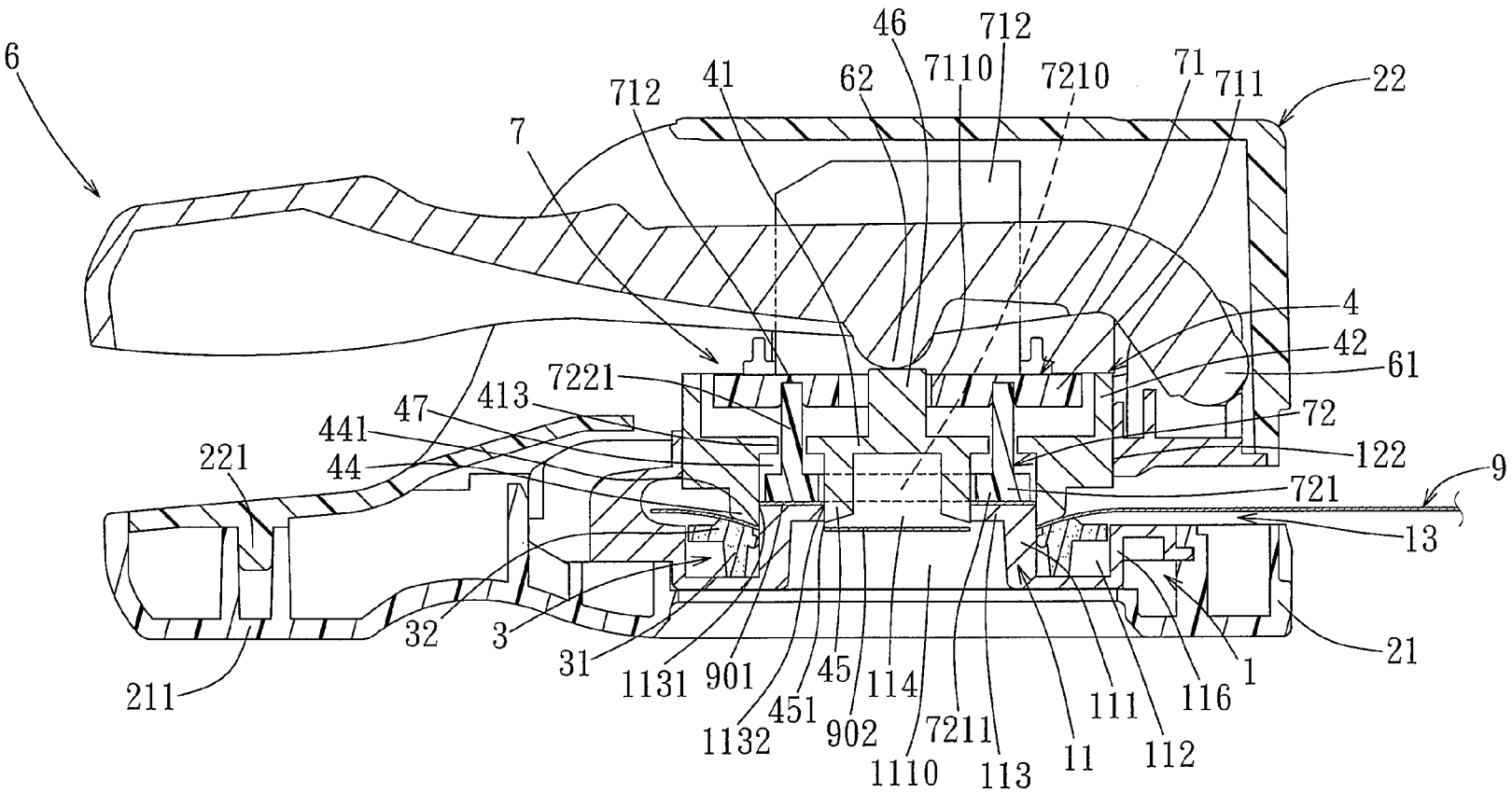
FIG. 9 is a sectional view of the first preferred embodiment, illustrating a state where the punch is disposed at a lower position.

The base 1 includes a die part 11 with a loop-shaped top wall 113 defining outer and inner die edges 1131, 1132 and adapted to support the first cutout portion 901 (see FIG. 9) thereon, and a loop-shaped support part 12 disposed above the die part 11 and connected to and cooperating with the die part 11 to form a U-shape body and to define an accommodating space 13 therebetween for receiving the workpiece 9 to be punched. The loop-shaped support part 12 is formed with a frame space 122 for extension of the punch 4 and the ejecting unit 7 therethrough, and has a plurality of studs 123 protruding therefrom.

The punch 4 includes a circular head wall 41, a surrounding wall 42 extending upwardly from a periphery of the head wall 41, loop-shaped outer and inner blades 44, 45 extending downwardly from the head wall 41 and disposed below the head wall 41, and a plurality of hollow retainers 43 formed on the surrounding wall 42. The punch 4 is provided with an urging member 5 that includes a plurality of coil springs 51, each of which extends into a respective one of the hollow retainers 43 and is sleeved on a respective one of the studs 123 (see FIG. 7) to abut against the support part 12 so that the punch 4 can be movably supported on the support part 12 of the base 1 through the urging member 5 and that the punch 4 is movable relative to the die part 11 of the base 1 and the abutting member defined by the upper housing 22 between upper and lower positions (see FIGS. 6 and 9). The punch 4 has outer and inner blade edges 441, 451 defined by the outer and inner blades 44, 45, respectively. The outer and inner blade edges 44, 45 of the punch 4 are slidable toward the outer and inner die edges 1131, 1132 of the die part 11 to provide a shear force for cutting the workpiece 9. The outer and inner blade edges 441, 451 are disposed above the outer and inner die edges 1131, 1132 when the punch 4 is disposed at the upper position, and below the outer and inner die edges 1131, 1132 when the punch 4 is disposed at the lower position. The head wall 41 is formed with a protrusion 46 protruding upwardly therefrom.

Figure 6:
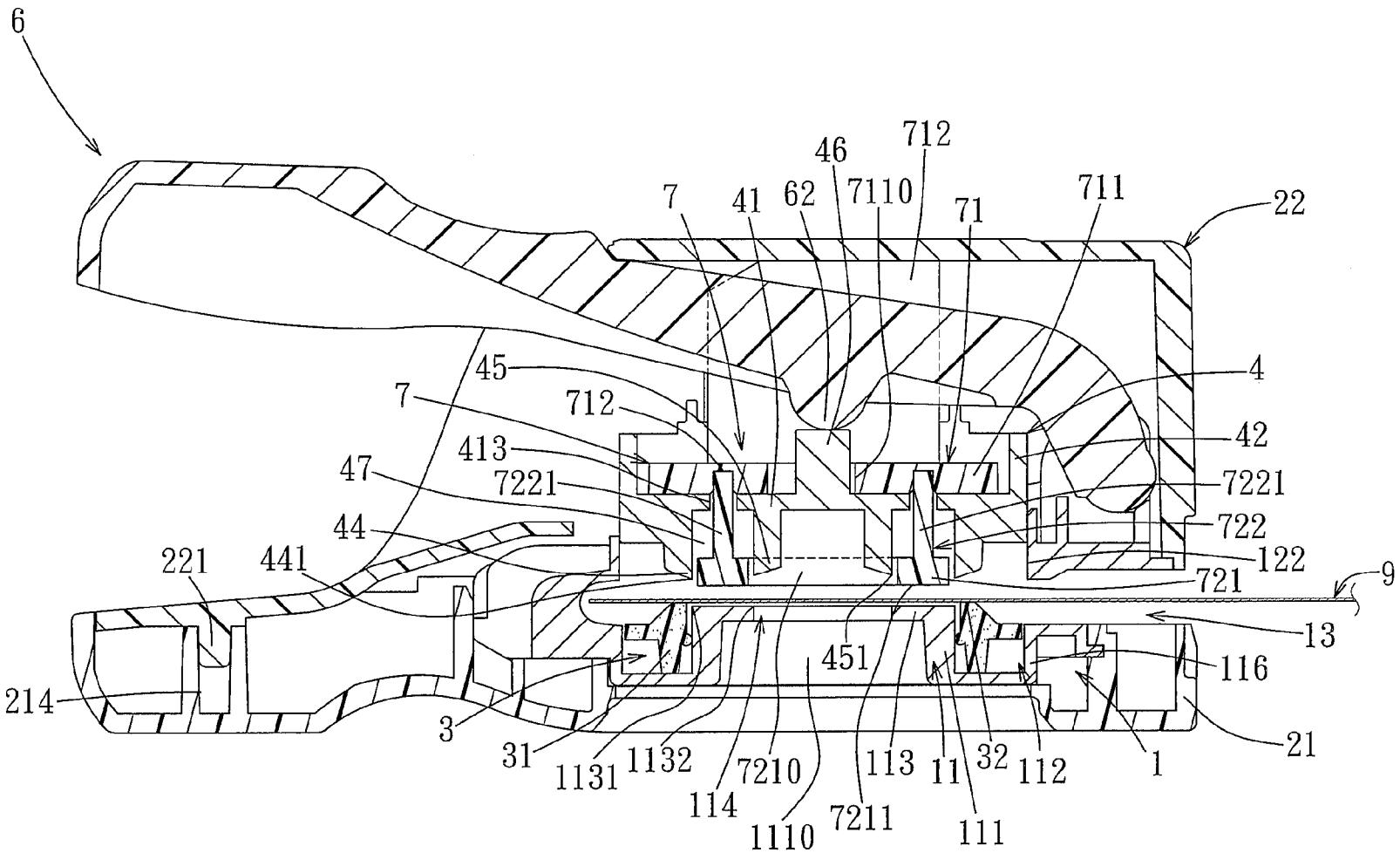
FIG. 6 is a sectional view of the first preferred embodiment taken along line VI-VI of FIG. 3, illustrating a state where a punch is disposed at an upper position before punching.
Figure 6A:
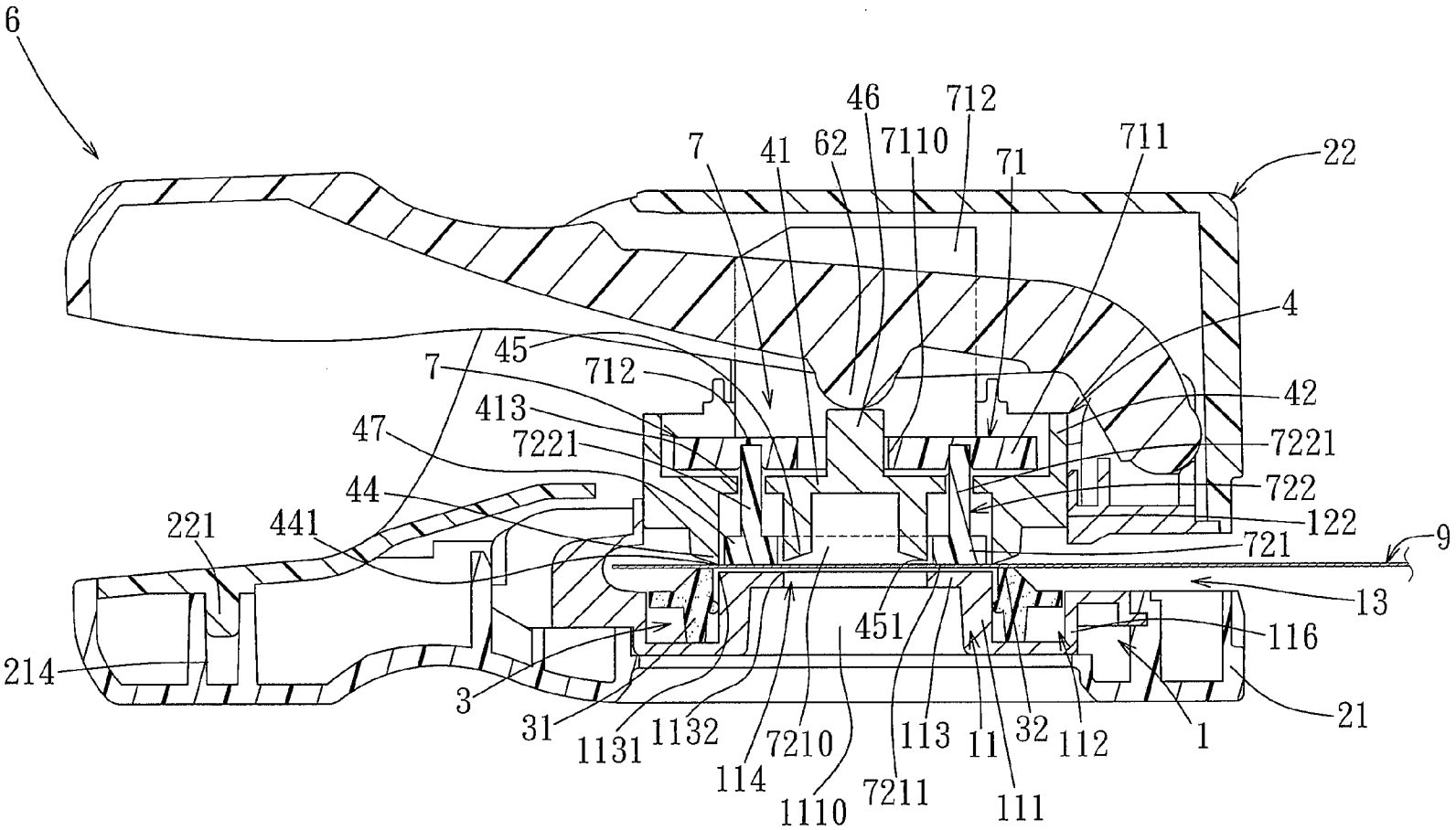
FIG. 6A is a sectional view of the first preferred embodiment, illustrating a state where the punch is disposed at a middle position.
Figure 7:
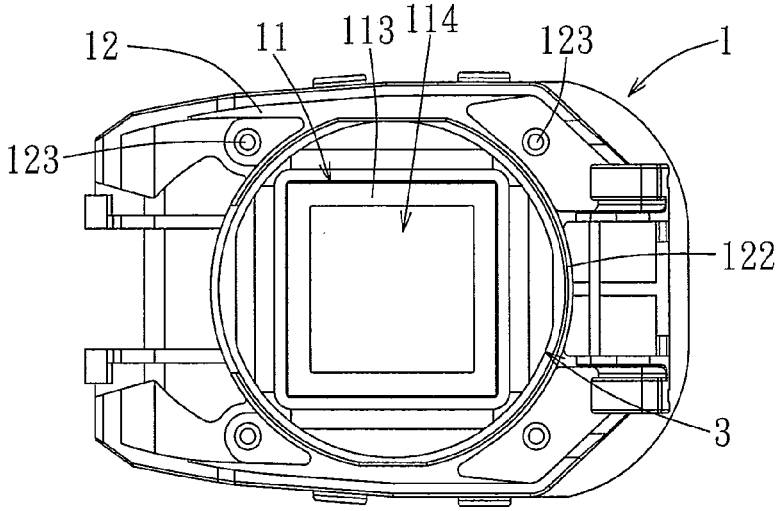
FIG. 7 is a schematic top view of a base and an elastic pad of the first preferred embodiment.
Figure 8:
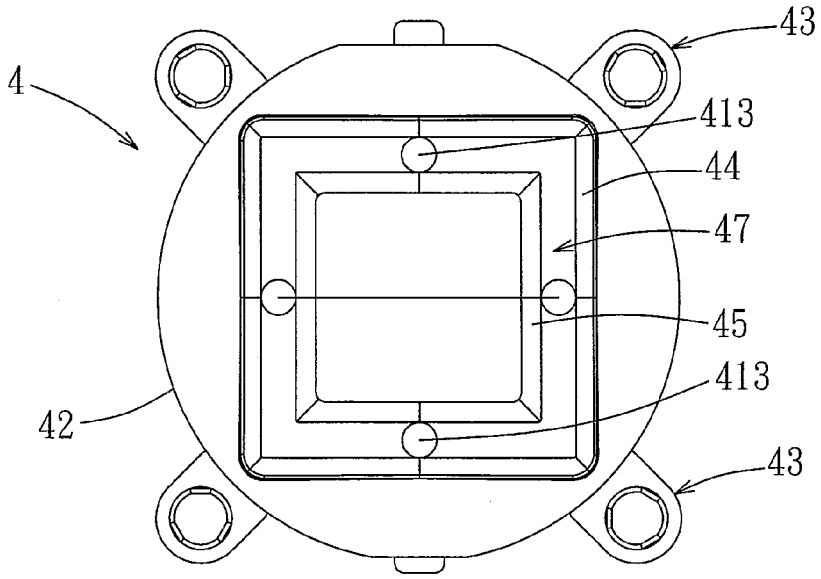
FIG. 8 is a schematic top view of the punch of the first preferred embodiment.
Figure 10:
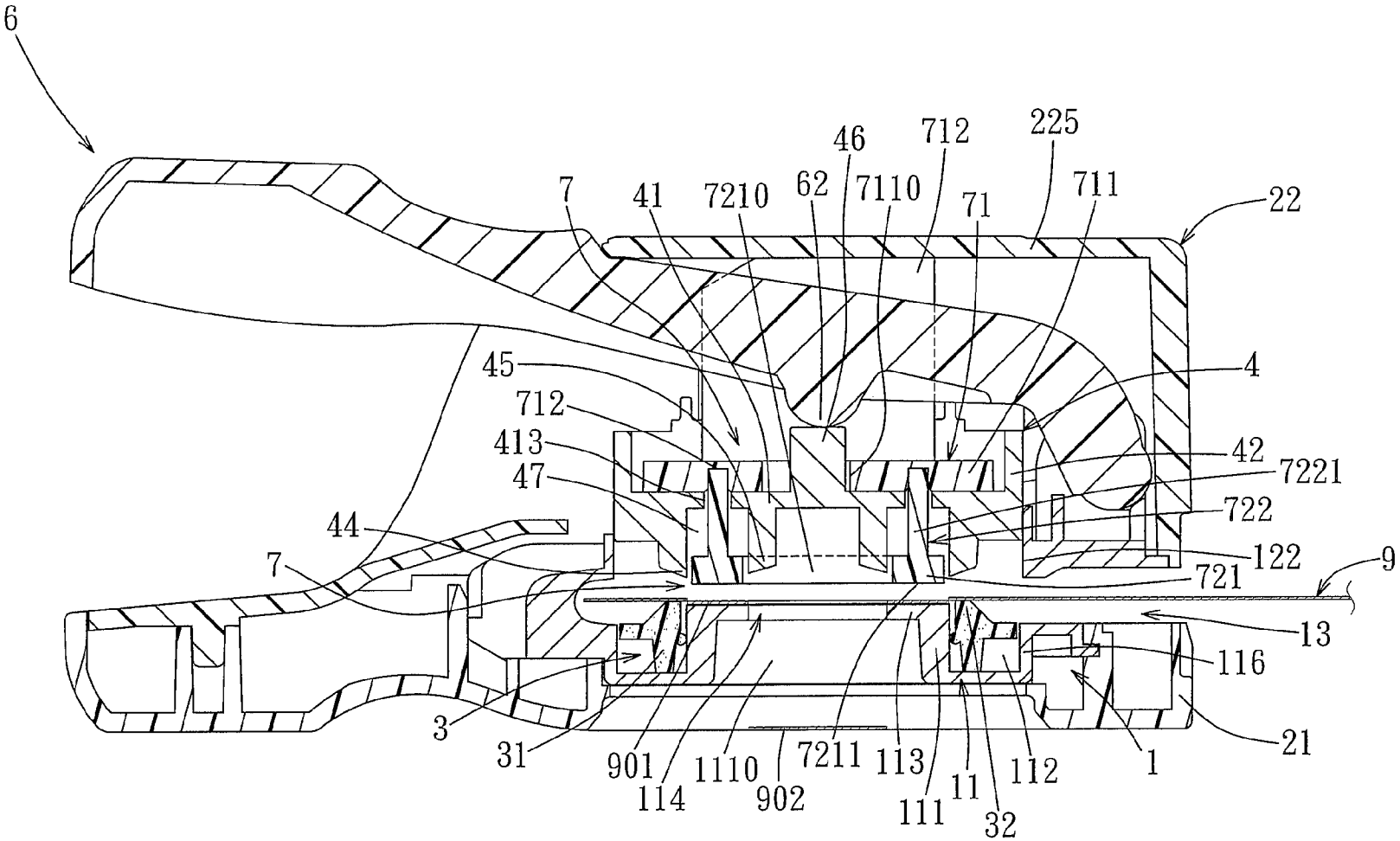
FIG. 10 is a sectional view of the first preferred embodiment, illustrating a state where the punch is disposed at the upper position after punching.

The ejecting unit 7 is disposed over the top wall 113 of the die part 11, and includes a non-compressible upper holder 71 disposed above the head wall 41 of the punch 4, a non-compressible loop-shaped ejecting element 721 disposed below the head wall 41 and in the form of a rectangular frame which defines a frame space 7210, and a non-compressible interconnecting member 722 extending through the head wall 41 of the punch 4 and interconnecting the upper holder 71 and the ejecting element 721. When the punch 4 is disposed at the upper position (see FIGS. 6 and 10), the ejecting element 721 is disposed above and is spaced apart from the top wall 113 of the die part 11, and the inner blade edge 451 of the inner blade 45 is received in the frame space 7210 of the ejecting element 721. When the punch 4 is disposed at a middle position (see FIG. 6A) between the upper and lower positions, the ejecting element 721 abuts against the top wall 113 of the die part 11, the inner blade edge 451 of the inner blade 45 is received in the frame space 7210, and the outer and inner blade edges 441, 451 are substantially flush with the outer and inner die edges 1131, 1132. When the punch 4 is disposed at the lower position (see FIG. 9), the ejecting element 721 remains abutting against the top wall 113 of the die part 11 and the inner blade 45 extends through the frame space 7210 of the ejecting element 721, i.e., the inner blade edge 451 of the inner blade 45 is disposed below the frame space 7210. The ejecting unit 7 is movably connected to the punch 4 such that the ejecting unit 7 is indirectly supported on the base 1 through the punch 4 when the punch 4 is disposed between the upper and middle positions, and is directly supported on the top wall 113 of the die part 11 of the base 1 when the punch 4 is disposed between the middle and lower positions.

The upper holder 71 of the ejecting unit 7 is slidably sleeved on the protrusion 46 so as to permit the ejecting unit 7 to be movably supported on the head wall 41 of the punch 4 when the punch 4 is disposed at the upper position, which, in turn, permits co-movement of the ejecting unit 7 with the punch 4 relative to the die part 11 during movement of the punch 4 from the upper position to the middle position, and further permits movement of the punch 4 relative to the ejecting unit 7, which remains stationary, during movement of the punch 4 from the middle position to the lower position. The ejecting unit 7 is blocked against co-movement with the punch 4 by the top wall 113 of the die part 11 during movement of the punch 4 from the middle position to the lower position. In this preferred embodiment, the ejecting element 721 has a bottom end face 7211 that is disposed below the outer and inner blade edges 441, 451 when the punch 4 is disposed at the upper position (see FIGS. 6 and 10) so as to ensure that the bottom end face 7211 of the ejecting element 721 can be in contact with the first cutout portion 901 of the workpiece 9 for facilitating ejection of the first cutout portion 901 when the workpiece 9 is undesirably raised by the punch 4 upon restoration of the punch 4 to the upper position. In this embodiment, the ejecting unit 7 is a non-flexible piece, and is preferably made from a non-elastic plastic material.

The head wall 41 of the punch 4 is further formed with a plurality of through-holes 413. The interconnecting member 722 has a plurality of connecting rods 7221, each of which extends upwardly from the ejecting element 721 through a respective one of the through-holes 413 in the head wall 41 to connect with the upper holder 71. The upper holder 71 is formed with a plurality of retaining holes 712. Each of the connecting rods 7221 has an end fitted securely into a respective one of the retaining holes 712.

The lower housing 21 has one end 211 coupled detachably to one end 221 of the upper housing 22. The lower and upper housings 21, 22 cooperatively define a receiving space for receiving the base 1, the punch 4, and the ejecting unit 7 therein. The die part 11 and the support part 12 engage detachably the lower and upper housings 21, 22, respectively, in a tongue-and-groove engaging manner. The upper housing 22 is disposed over and covers the ejecting unit 7. The upper holder 71 of the ejecting unit 7 has an upper plate 711 that is formed with the retaining holes 712 and an aperture 7110 for extension of the protrusion 46 of the punch 4 therethrough so as to be sleeved slidably on the protrusion 46, and a pair of abutting plates 713 that extend upwardly from the upper plate 711. The abutting plates 713 of the upper holder 71 of the ejecting unit 7 abut against the abutting member defined by the upper housing 22 when the punch 4 is disposed at the upper position so as to permit the ejecting element 721 to eject the first cutout portion 901 of the workpiece 9, which is undesirably raised from the top wall 113 of the die part 11 by the punch 4 during restoration of the punch 4 from the lower position to the upper position, from the punch 4.

The operating lever 6 has one end 61 pivoted to the support part 12 of the base 1 so as to be rotatable relative to the support part 12, extends outwardly therefrom through a side wall 224 of the upper housing 22, and is formed with a driving tongue 62 abutting against the protrusion 46 of the punch 4 for driving movement of the punch 4.

The outer and inner blades 44, 45 cooperatively define a loop-shaped gap 47 therebetween. The ejecting element 721 extends into the loop-shaped gap 47 when the punch is disposed at the upper position, and is entirely received in the loop-shaped gap 47 when the punch 4 is disposed at the lower position. The top wall 113 of the die part 11 has an opening 114. The die part 11 further has an inner surrounding wall 111 that extends downwardly from the top wall 113 and that defines an inner space 1110 in spatial communication with the opening 114 for receiving the second cutout portion 902 of the workpiece 9, and an outer surrounding wall 116 that is connected to and that surrounds the inner surrounding wall 111 and that cooperates with the inner surrounding wall 111 to define a receiving space 112 therebetween. The outer and inner blades 44, 45 extend into the receiving space 112 and the opening 114, respectively, when the punch 4 is disposed at the lower position. A loop-shaped elastic pad 3 is disposed in the receiving space 112, and has a loop-shaped top end 32 and a plurality of legs 31 extending downwardly from the loop-shaped top end 32 and seated on a bottom of the die part 11. The top end 32 of the elastic pad 3 is disposed slightly above the top wall 113 of the die part 11 for supporting the workpiece 9 thereon, and is spaced apart from the outer blade 44 when the punch 4 is disposed at the upper position. The top end 32 of the elastic pad 3 is disposed below the top wall 113 of the die part 11 and is compressed by the outer blade 44 when the punch 4 is disposed at the lower position.

In this embodiment, the bottom end face 7211 of the ejecting element 721 is flat.

Figure 12:
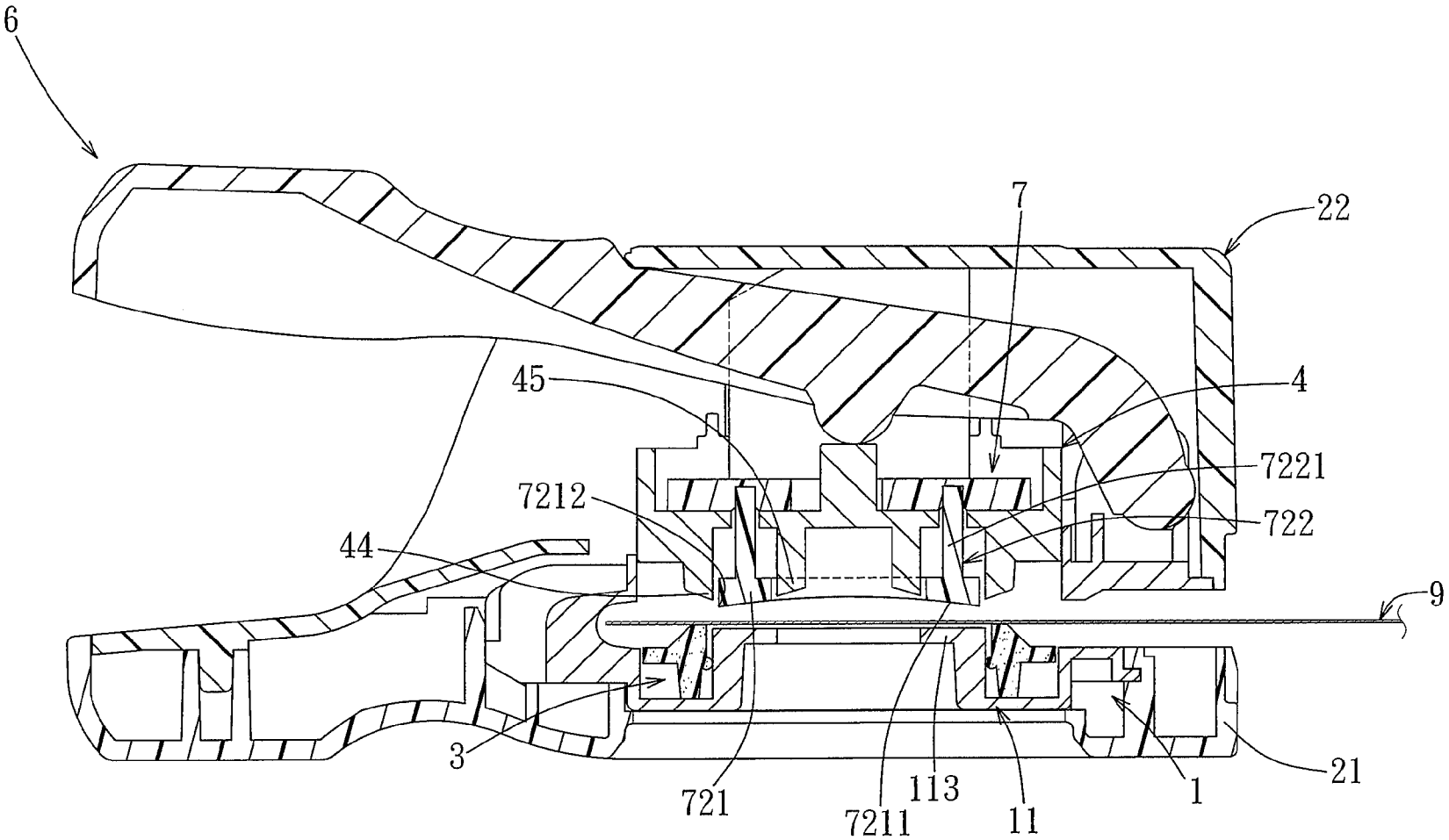
FIG. 12 is a sectional view of the second preferred embodiment of a punching device according to this invention.
Figure 13:
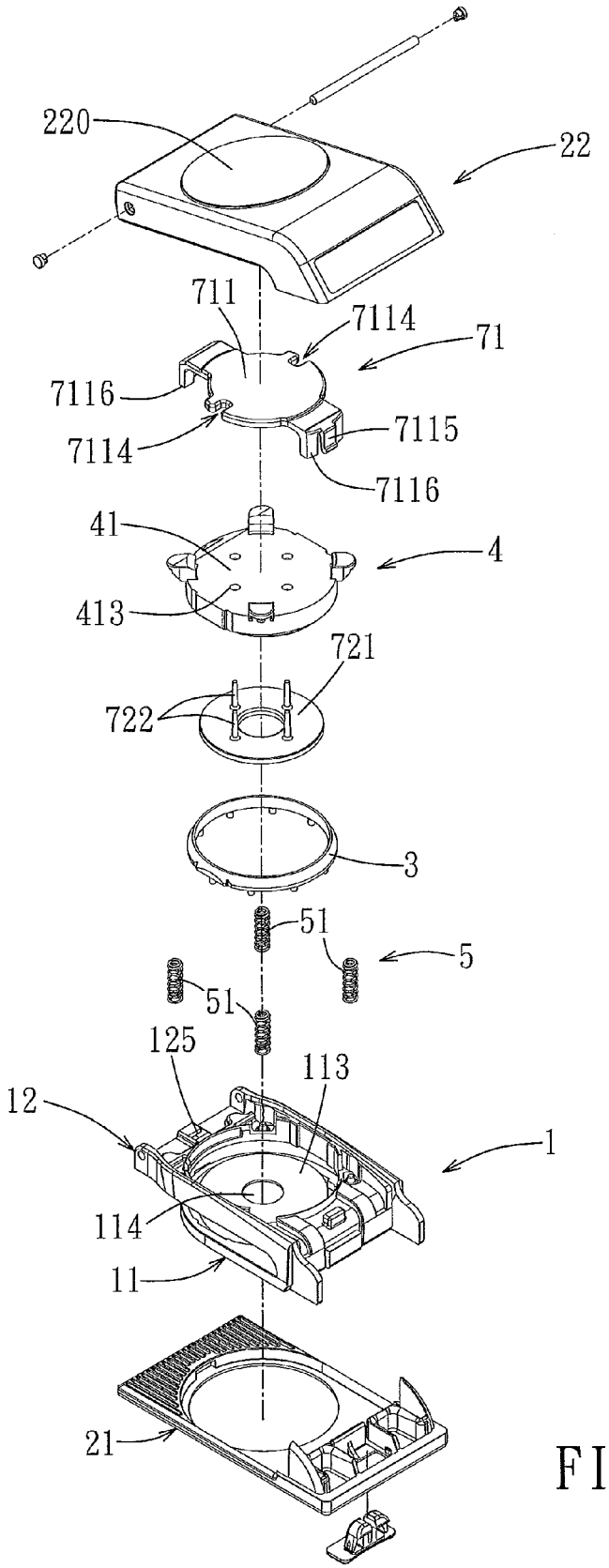
FIG. 13 is an exploded top perspective view of the third preferred embodiment.
Figure 14:
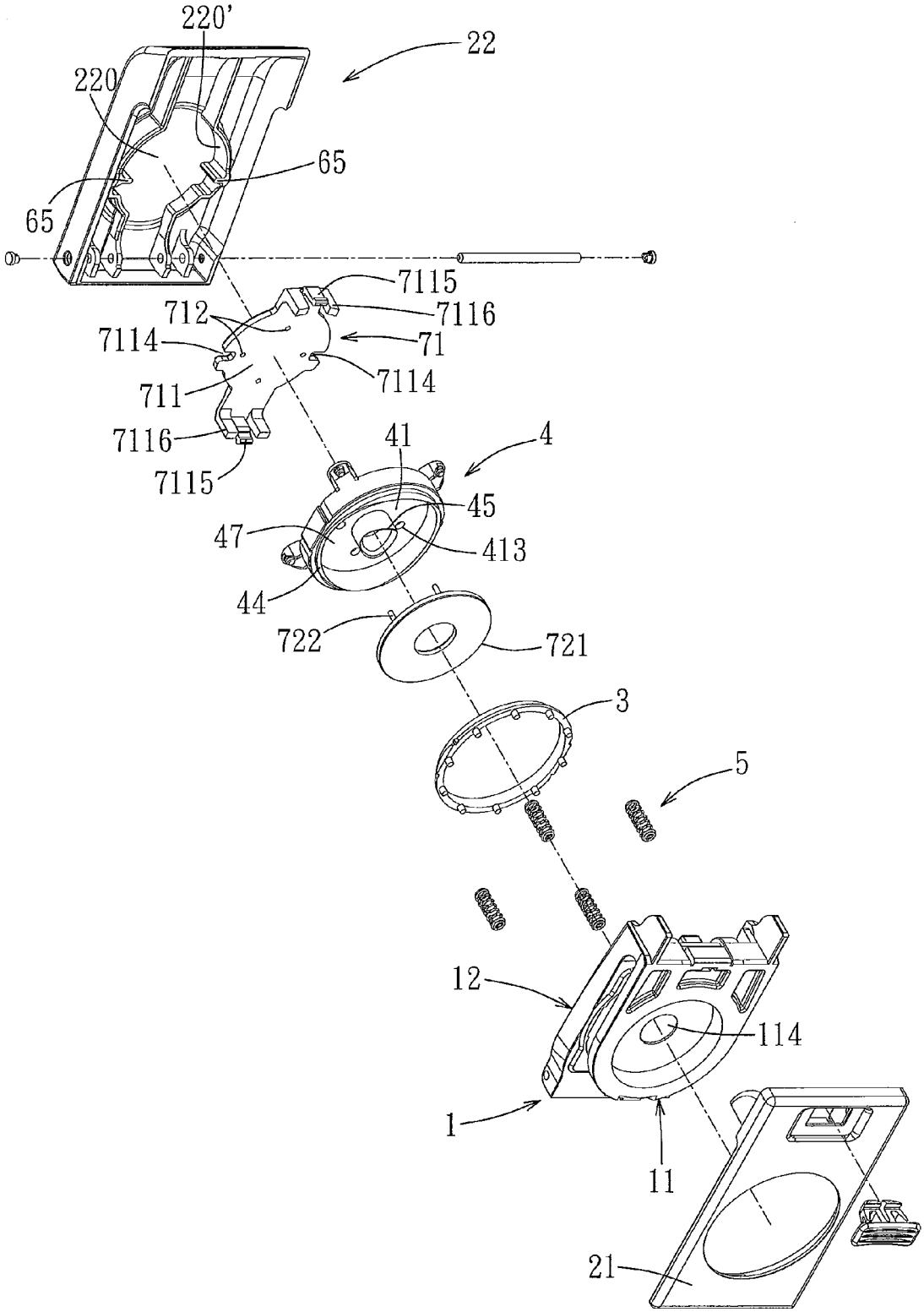
FIG. 14 is an exploded bottom perspective view of the third preferred embodiment.

FIG. 12 illustrates the second preferred embodiment of the punching device according to this invention. The second preferred embodiment differs from the previous embodiment in that the bottom end face 7211 of the ejecting element 721 is concave and has an outer peripheral edge 7212. The outer peripheral edge 7212 of the bottom end face 7211 of the ejecting element 721 abuts against the first cutout portion 901 of the workpiece 9, which is undesirably raised by the punch 4 during restoration of the punch 4 from the lower position to the upper position, to deform the first cutout portion 901 when the punch 4 is moved to the upper position, thereby facilitating ejection of the first cutout portion 901 from the punch 4.

FIGS. 13 to 16 illustrate the third preferred embodiment of a punching device according to this invention. The third preferred embodiment differs from the previous embodiments in that the upper holder 71 is secured to the support part 12 of the base 1 in a snap-fitting manner so as to permit movement of the punch 4 relative to the ejecting unit 7 during movement of the punch 4 between the upper and lower positions (see FIGS. 15 and 16). The support part 12 of the base 1 is further formed with two opposite abutting pieces 125 that cooperatively define an abutting member. The upper holder 71 has an upper plate 711 disposed over the head wall 41, connected to the ejecting element 721 by the interconnecting member 722, and formed with two opposite clamping arms 7115 that abut against and engage the abutting pieces 125, respectively, in a neck-and-shoulder snap-fitting manner so as to prevent upward movement of the ejecting unit 7 relative to the base 1. The upper plate 711 of the upper holder 71 is further formed with two opposite abutting portions, each of which includes a pair of abutting legs 7116 that are disposed respectively at two opposite sides of a respective one of the clamping arms 7115 and that abut against the support part 12 so as to prevent downward movement of the ejecting unit 7 relative to the base 1.

Figure 15:
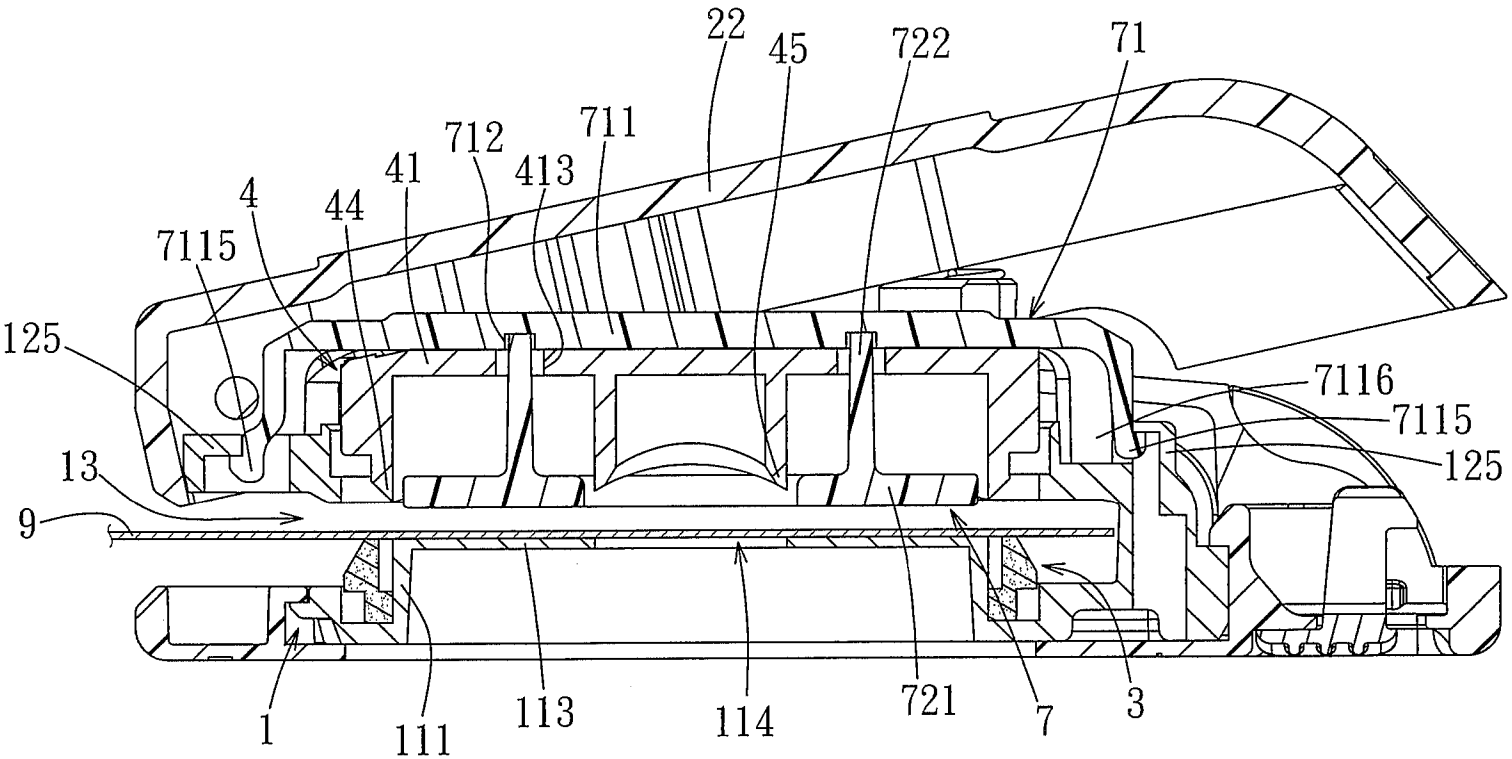
FIG. 15 is a sectional view of the third preferred embodiment, illustrating a state where an upper housing is disposed at a first angular position and a punch is disposed at an upper position.
Figure 16:
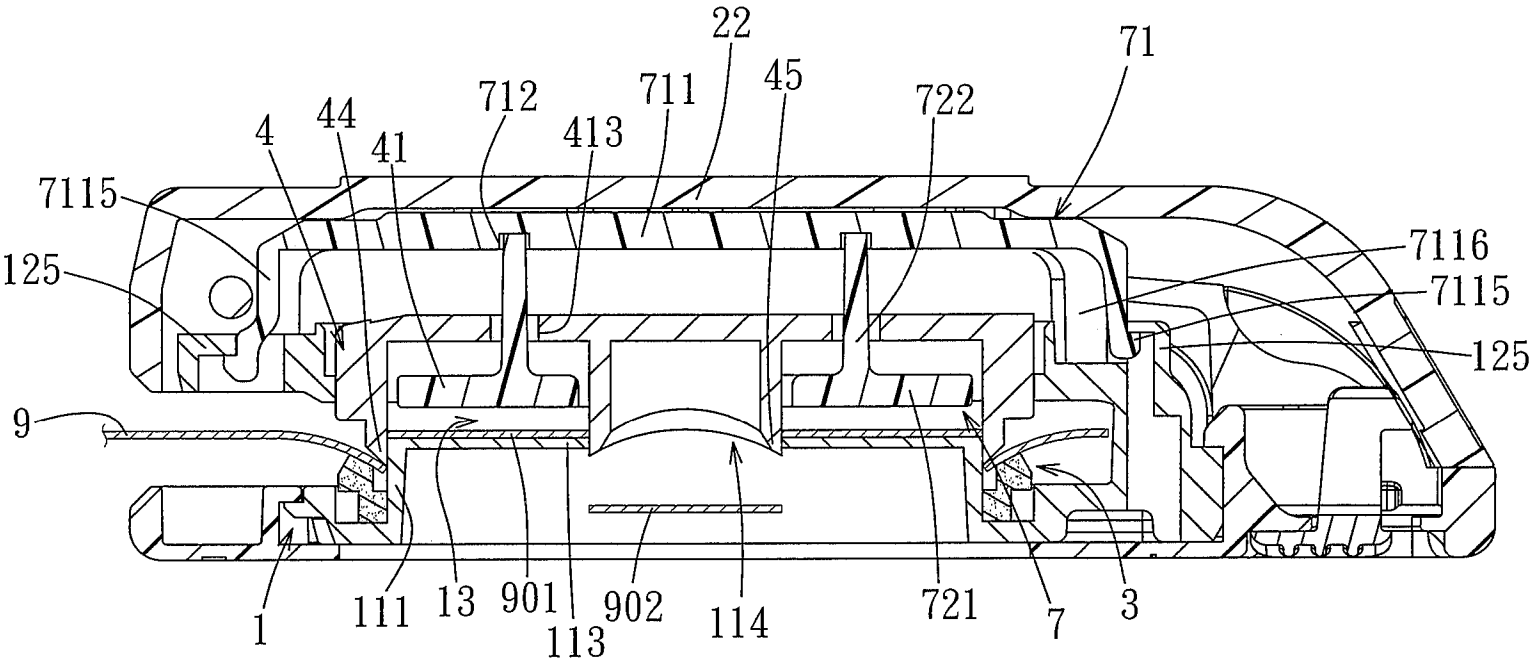
FIG. 16 is a sectional view of the third preferred embodiment, illustrating a state where the upper housing is disposed at a second angular position and the punch is disposed at a lower position.

In this embodiment, the upper housing 22 is pivoted to the support part 12 of the base 1 so as to be rotatable relative to the base 1 between first and second angular positions (see FIGS. 15 and 16). The upper housing 22 is formed with a middle recess 220 defined by a recess-defining wall 220'. The recess-defining wall 220' is formed with two opposite pressing projections 65 protruding into the middle recess 220. The upper plate 711 of the upper holder 71 is further formed with two opposite cutouts 7114. The pressing projections 65 are disposed above the upper plate 711 when the upper housing 22 is disposed at the first angular position, and extend through the cutouts 7114 to press against the head wall 41 of the punch 4 when the upper housing 22 is disposed at the second angular position so as to drive movement of the punch 4 from the upper position to the lower position.

With the inclusion of the abutting member defined by the upper housing 22 of the first or second preferred embodiment or by the abutting pieces 125 of the third preferred embodiment in the punching device of this invention for limiting the ejecting unit 7, the aforementioned drawbacks associated with the prior art can be eliminated.

With the invention thus explained, it is apparent that various modifications and variations can be made without departing from the spirit of the present invention.

What is claimed is:

1. A punching device for cutting a workpiece to form a cutout portion, comprising:

a base including a die part that has a top wall defining at least one die edge and adapted to support the cutout portion thereon;

an abutting member connected to said base;

a spring-biased punch supported on said base, movable relative to said die part and said abutting member between upper and lower positions, and having at least one blade edge, said blade edge being disposed above said die edge when said punch is disposed at the upper position, and being disposed below said die edge when said punch is disposed at the lower position, said blade edge being slidable toward said die edge for cutting the workpiece; and an ejecting unit supported on said base and including a non-compressible ejecting element disposed above and adjacent to said top wall of said die part, said punch being movable relative to said ejecting unit at least during movement of said punch from a middle position between the upper and lower positions, where said blade edge is substantially flush with said die edge, to the lower position, said ejecting unit abutting against said abutting member at least when said punch is disposed at the upper position so as to permit said ejecting element to eject the cutout portion of the workpiece, which is undesirably raised by said punch upon restoration of said punch from the lower position to the upper position, from said punch wherein said punch includes a head wall formed with at least one through-hole, said blade edge being disposed below and connected to said head wall, said ejecting unit further including an upper holder that is disposed above said head wall, said ejecting element being disposed below said head wall, said ejecting unit further including an interconnecting member extending through said through-hole in said head wall to interconnect said upper holder and said ejecting element, wherein said upper holder is secured to said base in a snap-fitting manner so as to permit movement of said punch relative to said ejecting unit during movement of said punch between the upper and lower positions, and wherein said base further includes a support part disposed above and connected to said die part and formed with two opposite abutting pieces that cooperatively define said abutting member, said upper holder having an upper plate formed with two opposite clamping arms that abut against and engage said abutting pieces, respectively, in a neck-and-shoulder snap-fitting manner.

2. The punching device of claim 1, wherein said punch further includes outer and inner blades defining said at least one blade edge, said outer and inner blades cooperatively defining a gap therebetween, said ejecting element extending into said gap, said top wall of said die part defining an opening, said die part further including an inner surrounding wall that extends downwardly from said top wall, and an outer surrounding wall that is connected to and that surrounds said inner surrounding wall and that cooperates with said inner surrounding wall to define a receiving space therebetween, said outer and inner blades extending into said receiving space and said opening, respectively, when said punch is disposed at the lower position.

3. The punching device of claim 2, further comprising an elastic pad disposed in said receiving space and having a top end, said top end of said elastic pad being disposed slightly above said top wall of said die part and being spaced apart from said outer blade when said punch is disposed at the upper position, and being disposed below said top wall of said die part and compressed by said outer blade when said punch is disposed at the lower position.

4. The punching device of claim 1, wherein said upper plate is further formed with two opposite abutting legs that are disposed respectively at two opposite sides of a respective one of said clamping arms and that abut against said support part.

5. The punching device of claim 1, wherein said ejecting element abuts against said top wall of said die part when said punch is disposed at the middle position, said ejecting unit being movably supported on said punch so as to be co-movable with said punch relative to said die part during movement of said punch from the upper position to the middle position, and so as to permit said punch to be movable relative to said ejecting unit during movement of said punch from the middle position to the lower position.

6. The punching device of claim 5, wherein said spring-biased punch is provided with an urging member that is mounted on said base and that abuts resiliently against said spring-biased punch for biasing said spring-biased punch toward the upper position.

7. The punching device of claim 6, wherein said base further includes a loop-shaped support part disposed above said die part and connected to and cooperating with said die part to form a U-shape body and to define an accommodating space adapted for receiving the workpiece, said punch being supported on said loop-shaped support part by said urging member.

8. The punching device of claim 7, further comprising upper and lower housings, said die part and said loop-shaped support part engaging detachably said lower and upper housings, respectively.

9. The punching device of claim 5, wherein said punch further includes outer and inner blades defining said at least one blade edge and extending downwardly from said head wall, said upper holder being seated on said head wall of said punch when said punch is disposed at the upper position.

10. The punching device of claim 9, wherein said ejecting element has a bottom end face that is disposed below said blade edge when said punch is disposed at the upper position.

11. The punching device of claim 10, wherein said bottom end face of said ejecting element is concave and has an outer peripheral edge, said outer peripheral edge of said bottom end face abutting against said top wall of said die part when said punch is disposed at the middle position.

12. The punching device of claim 9, wherein said interconnecting member has at least one connecting rod extending upwardly from said ejecting element through said through-hole in said head wall to connect with said upper holder.

13. The punching device of claim 12, wherein said upper holder is formed with at least one retaining hole, said connecting rod having an end fitted securely into said retaining hole.

14. A punching device for cutting a workpiece to form a cutout portion, comprising:

a base including a die part that has a top wall defining at least one die edge and adapted to support the cutout portion thereon;

an abutting member connected to said base;

a spring-biased punch supported on said base, movable relative to said die part and said abutting member between upper and lower positions, and having at least one blade edge, said blade edge being disposed above said die edge when said punch is disposed at the upper position, and being disposed below said die edge when said punch is disposed at the lower position, said blade edge being slidable toward said die edge for cutting the workpiece; and an ejecting unit supported on said base and including a non-compressible ejecting element disposed above and adjacent to said top wall of said die part, said punch being movable relative to said ejecting unit at least during movement of said punch from a middle position between the upper and lower positions, where said blade edge is substantially flush with said die edge, to the lower position, said ejecting unit abutting against said abutting member at least when said punch is disposed at the upper position so as to permit said ejecting element to eject the cutout portion of the workpiece, which is undesirably raised by said punch upon restoration of said punch from the lower position to the upper position from said punch, wherein said punch includes a head wall formed with at least one through-hole, said blade edge being disposed below and connected to said head wall, said ejecting unit further including an upper holder that is disposed above said head wall, said ejecting element being disposed below said head wall, said ejecting unit further including an interconnecting member extending through said through-hole in said head wall to interconnect said upper holder and said ejecting element, wherein said upper holder is secured to said base in a snap-fitting manner so as to permit movement of said punch relative to said ejecting unit during movement of said punch between the upper and lower positions, said punching device further comprising an upper housing disposed over and covering said ejecting unit and pivoted to said base so as to be rotatable relative to said base between first and second angular positions, said upper housing being formed with a middle recess defined by a recess-defining wall, said recess-defining wall being formed with at least one pressing projection protruding into said middle recess, said upper holder having an upper plate disposed over said head wall and formed with at least one cutout, said pressing projection being disposed above said upper plate when said upper housing is disposed at the first angular position and extending through said cutout to press against said head wall of said punch when said upper housing is disposed at the second angular position so as to drive movement of said punch from the upper position to the lower position.

* * * * *